US005221055A

United States Patent [19]

Kuan

[11] Patent Number: 5,221,055

[45] Date of Patent: Jun. 22, 1993

[54] GRINDING MIXER

[76] Inventor: Chen Y. Kuan, No. 181-1, Hai Pin Rd., Shou Shui Li, Ching Shui Chen, Taichung Hsien, Taiwan

[21] Appl. No.: 942,488

[22] Filed: Sep. 9, 1992

[51] Int. Cl.[5] ..... B02C 19/22

[52] U.S. Cl. ..... 241/199.12; 99/510

[58] Field of Search ..... 241/199.12; 99/510

[56] References Cited

U.S. PATENT DOCUMENTS

| | | | |
|---|---|---|---|
| 3,434,518 | 3/1969 | Motis | 241/199.12 |
| 4,537,123 | 8/1985 | Holcomb | 99/510 X |
| 4,815,671 | 3/1989 | Akira | 241/199.12 X |
| 4,878,627 | 11/1989 | Otto | 241/199.12 |

*Primary Examiner*—Mark Rosenbaum
*Assistant Examiner*—Frances Chin
*Attorney, Agent, or Firm*—Lowe, Price, LeBlanc & Becker

[57] ABSTRACT

A grinding mixer includes a casing supported on a base, an auger stirrer projected into the casing and driven to rotate on its own axis by a motor through a reducing gear set, a toothed disk having downward teeth along its circular peripheral edge in mesh with the reducing gear set, wherein rotating the motor causes the auger stirrer to revolve on its own axis, and simultaneously causes the reducing gear to carry the auger stirrer along the circular peripheral edge of the toothed disk so as to mix materials well. The auger stirrer has a unitary grinding plate on the bottom for grinding materials to powder as it is rotated to mix materials. A scraper blade is carried by the reducing gear to scrape the inside surface of the casing as the auger stirrer is rotated to grind and mix materials.

3 Claims, 3 Drawing Sheets

GRINDING MIXER

BACKGROUND OF THE INVENTION

The present invention relates to a grinding mixer for use in the food industry in grinding food materials while mixing.

A variety of mixers are known and widely used in the food industry for mixing foods. These mixers are generally comprised of a stirrer with 2 or 3 blades driven by a motor to rotate on a fixed point in stirring food materials in a container. These mixers are suitable for mixing liquefied food materials but not satisfactory in use for mixing food materials of high viscosity. There is still another structure of mixer which utilizes an auger stirrer for mixing food materials of high viscosity. However, this structure of mixer can not crush grains to powder. Furthermore, viscous food materials may be adhered to the inside surface of the container of a mixer during the process of mixing. Neither of the aforesaid mixers provides means for scraping the inside surface of the respective container.

SUMMARY OF THE INVENTION

The present invention has been accomplished under the aforesaid circumstances. It is therefore the main object of the present invention to provide a grinding mixer which grind materials to powder while mixing. According to one aspect of the present invention, the grinding mixer is generally comprised of an auger stirrer projected into the casing thereof and driven by a motor through a reducing gear set to rotate on its own axis, and a toothed disk having downward teeth along its circular peripheral edge in mesh with the reducing gear set, wherein rotating the motor causes the auger stirrer to revolve on its own axis, and simultaneously causes the reducing gear set to carry the auger stirrer along the circular peripheral edge of the toothed disk so as to mix materials well. According to another aspect of the present invention, a scraper blade is fastened to the reducing gear set on one side and carried to rub against the inside surface of the casing as the auger stirrer is rotated, and therefore a satisfactory mixing effect can be achieved. According to still another aspect of the present invention, a container is fastened in the base of the grinding mixer for carrying finished materials, and a hand wheel is rotated to lift a pressure plate in the container in squeezing finished materials out of an output port on the base.

DETAILED DESCRIPTION OF THE PREFERRED EMBODIMENT

Figure 1:
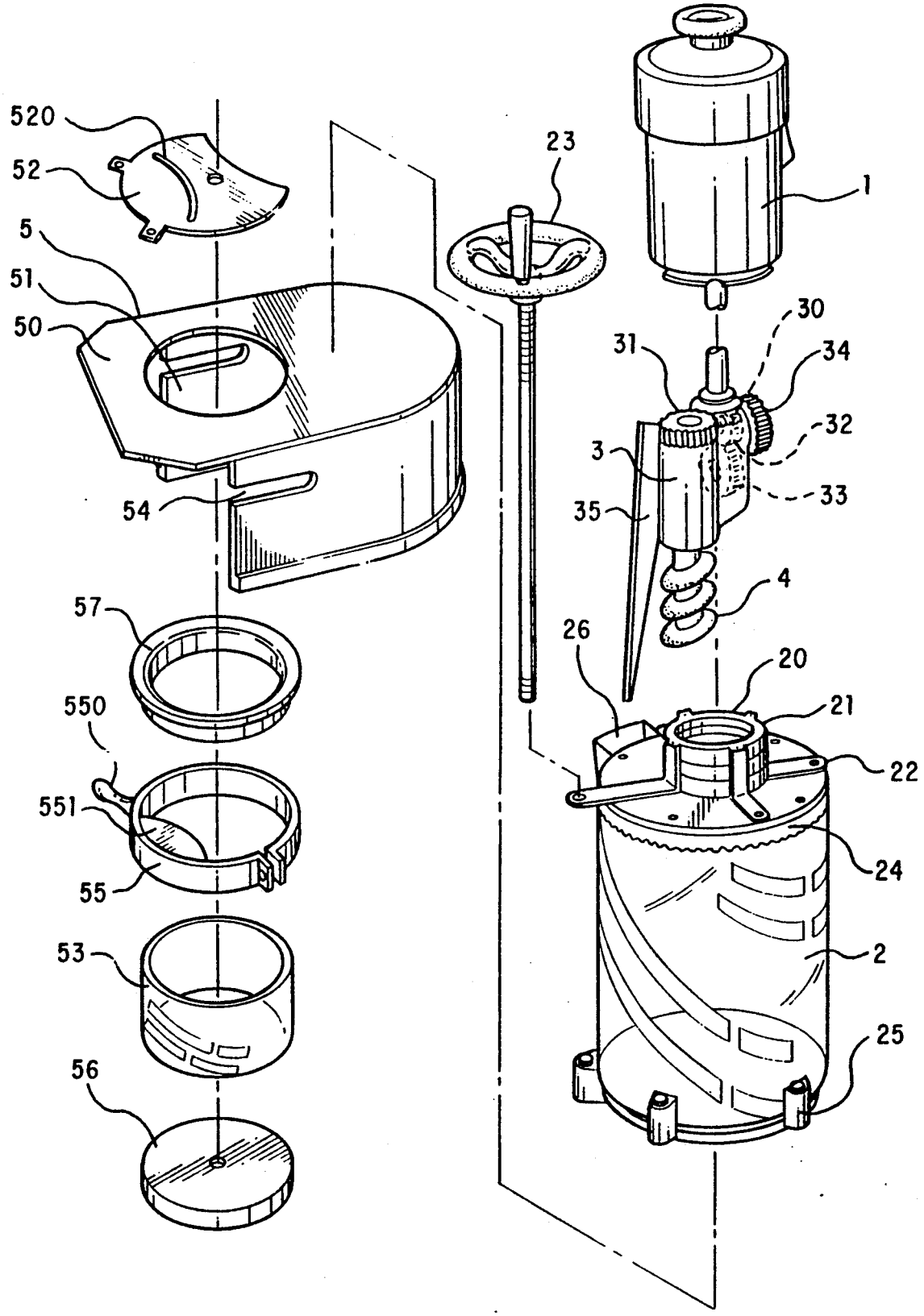
FIG. 1 is an exploded view of a grinding mixer according to the present invention.
Figure 2:
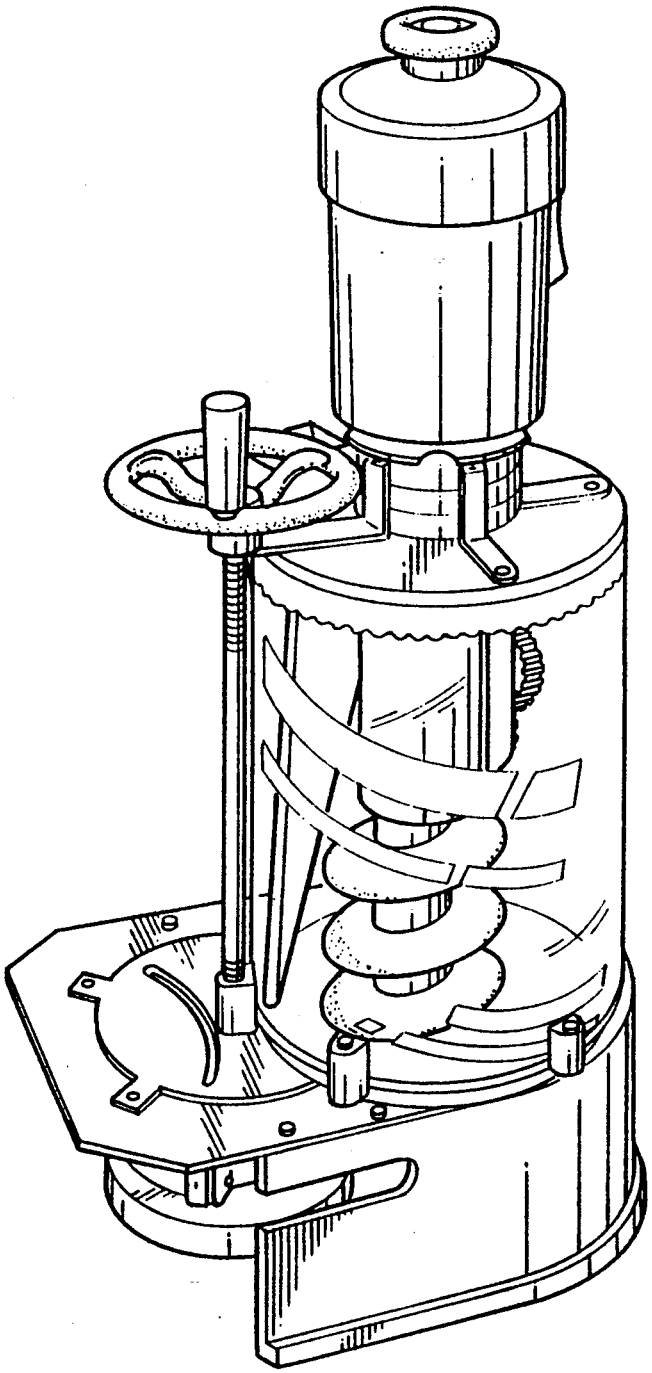
FIG. 2 is an elevational view thereof.
Figure 3:
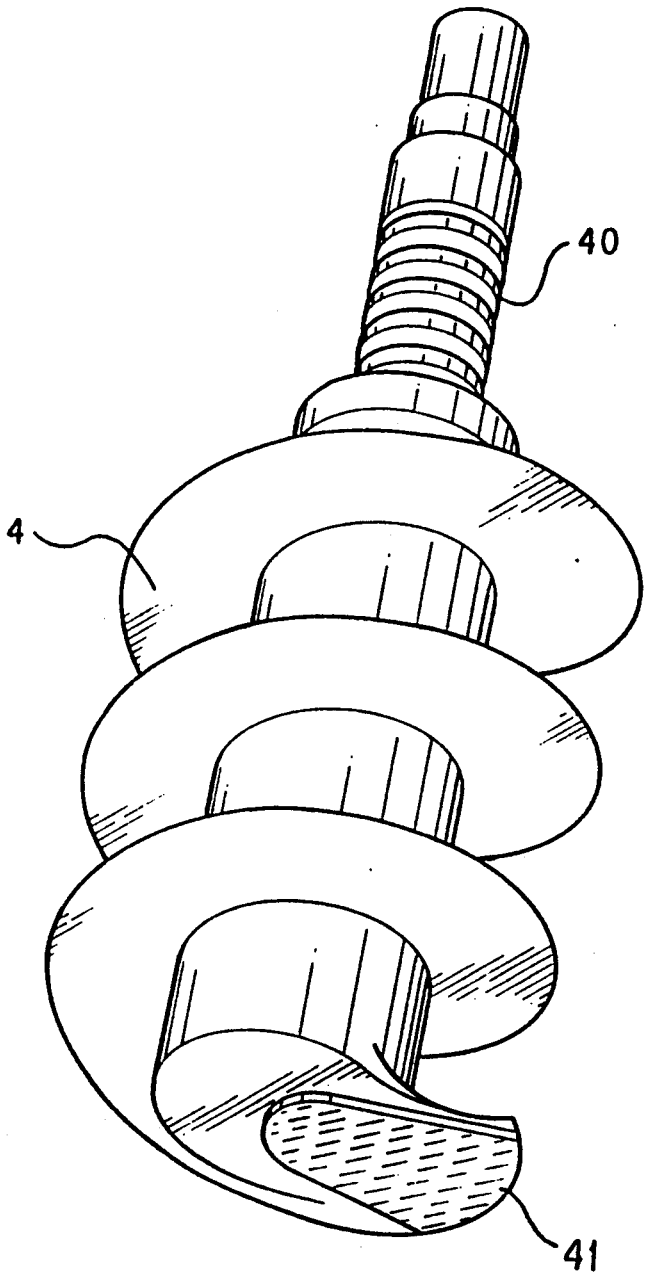
FIG. 3 is an elevational view of the auger stirrer of the grinding mixer.

Referring to FIGS. 1 and 2, a grinding mixer as constructed in accordance with the present invention is generally comprised of a motor 1, a casing 2, a reducing gear set 3, an auger stirrer, and a base 5. The motor 1 is a single-phase motor controlled by an ON/OFF switch (not shown). The casing 2 is made from transparent K-resin having a neck 20 upstanding from the flat top edge thereof, a feed hole 26 at a higher level, a plurality of bearings 21 fastened inside the neck 20 to hold the output shaft (not indicated) of the motor 1, a plurality of radial ribs 22 on the outside respectively extended outwards along the outside surface of the neck 20 and the flat top edge of the casing 2, a toothed disk 24 fastened on the inside adjacent to the neck 20, and a plurality of internally threaded upright lugs 25 around the bottom thereof, through which screws are threaded into holes (not shown) on the base 5 to fasten the casing 2 above the base 5. The toothed disk 24 has a plurality of downward teeth along the peripheral edge thereof disposed in mesh with the reducing gear set 3, and therefore the reducing gear set 3 can be carried by the motor 1 to rotate along the teeth of the toothed disk 24. The reducing gear set 3 comprises a driving gear 30 coupled to the output shaft of the motor 1, a big gear 31 coupled to the auger stirrer 4 and meshed with the driving gear 30 on one side, and a set of transmission gears 32,33,34, and a scraper blade 35. The auger stirrer 4 is made from a rigid plastic having a worm gear 40 near the top and a grinding plate 41 on the bottom (see FIG. 3). When rotated by the big gear 31, the worm gear 40 drives the transmission gears 32,33,34 to rotate. The base 5 has an embossed top face 50 made from a stainless steel, a round hole 51 on the embossed top face 50 spaced from the top center thereof partly covered by a cover board 52 with a crescent shaped opening (not shown) left for passing finished material to a container 53 below. The container 53 is made from ABS resin and fastened to the base 5 below the round hole 51 by a shutter 55 and a rim 57. The shutter 55 comprises a crescent shaped cover blade 551 rotated by a handle 550 to block up or open the crescent shaped opening on the embossed top face 50 of the base 5. The bottom of the container 53 is blocked by a pressure plate 56, which is made from an aluminum alloy and coupled to a hand wheel 23. Rotating the hand wheel 23 causes the pressure plate 56 to be lifted in the container 53 in squeezing finished material against the cover board 52 causing it to move out of the base 5 through a curved slot 520 on the cover board 52.

The operation of the present invention is simple and outlined hereinafter. The material to be processed are filled into the casing 2 through the feed hole 26, and then the motor 1 is turned on to rotate the scraper blade 35 and the auger stirrer 4 in grinding and mixing the material. After the combined process of grinding and mixing, the shutter 55 is rotated aside to open the crescent shaped opening on the round opening 51 permitting the processed material to flow to the container 53, and then the hand wheel 23 is rotated to lift the pressure plate 56 in squeezing the processed material against the cover board 52, and therefore the processed material is squeezed out of the base 50 through the curved slot 520 on the cover board 52.

What is claimed is:

1. A grinding mixer comprising a casing supported on a base, a scraper blade, an auger stirrer projected into said casing and driven to rotate on its own axis by a motor through a reducing gear set for grinding and mixing materials, wherein said casing includes a toothed disk having a plurality of downward teeth around a circle in mesh with said reducing gear set so as to drive said auger stirrer about its axis while rubbing said scraper blade against the inside surface of said casing as said auger stirrer is rotated by said reducing gear set.

2. The grinding mixer according to claim 1 wherein said auger stirrer has a pre-cast grinding element on a bottom edge thereof rotated to rub against an embossed stainless steel plate on said base in grinding materials to powder.

3. The grinding mixer according to claim 1 wherein said base comprises a container to carry finished materials, and a hand wheel to lift a pressure plate in said container in squeezing finished materials out of an output port on said base.

* * * * *